US006318595B1

(12) United States Patent
Walters

(10) Patent No.: US 6,318,595 B1
(45) Date of Patent: Nov. 20, 2001

(54) FINGER-ACTUATABLE SPRAY PUMP PACKAGE WITH USER-READY TWO-PIECE SPRAY-THROUGH CAP, PRE-ASSEMBLY CAP, AND METHOD FOR MAKING SAID PACKAGE

(75) Inventor: Peter J. Walters, Barrington, IL (US)

(73) Assignee: SeaquistPerfect Dispensing Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/590,248

(22) Filed: Jun. 8, 2000

(51) Int. Cl.[7] ..... B67B 5/00

(52) U.S. Cl. ..... 222/1; 222/153.06; 222/321.8; 222/402.13

(58) Field of Search ..... 222/153.06, 153.1, 222/385, 321.8, 402.13, 321.7, 1

(56) References Cited

U.S. PATENT DOCUMENTS

| | | | |
|---|---|---|---|
| 3,223,287 | 12/1965 | Sagarin . | |
| 3,225,966 | 12/1965 | Sagarin . | |
| 3,227,321 | 1/1966 | Sagarin . | |
| 3,269,614 | 8/1966 | Abplanalp . | |
| 3,282,471 | 11/1966 | Lehmann . | |
| 3,305,179 | 2/1967 | Lehmann . | |
| 3,348,740 | 10/1967 | O'Donnell . | |
| 3,367,540 | 2/1968 | Lehmann . | |
| 3,539,078 | 11/1970 | Venus, Jr. . | |
| 4,095,725 | 6/1978 | Goncalves . | |
| 4,141,471 | 2/1979 | Nozawa . | |
| 4,420,096 | 12/1983 | Kirk, Jr. . | |
| 4,482,082 * | 11/1984 | Goncalves | 222/153.06 |
| 4,513,890 * | 4/1985 | Goncalves | 222/153.06 |
| 4,620,646 | 11/1986 | Crapser . | |
| 5,242,090 | 9/1993 | Reyss . | |
| 5,316,185 | 5/1994 | Meenan . | |
| 5,337,927 | 8/1994 | Laforcade . | |
| 5,622,286 | 4/1997 | Renault . | |
| 5,642,908 * | 7/1997 | Mascitelli | 222/321.7 |

* cited by examiner

*Primary Examiner*—Kevin Shaver
*Assistant Examiner*—Patrick Buechner
(74) *Attorney, Agent, or Firm*—Rockey, Milnamow & Katz, Ltd.

(57) ABSTRACT

A molded, unitary overcap structure for assembly on a finger-operable spray pump dispensing package is provided so that it can be subsequently modified to a two-piece, ready-to-use condition operatively engaged with a discharge tube of the pump. The actuator has a top surface and a periphery. The actuator defines an outlet, an inlet cavity, and an internal discharge passage extending between the outlet and the inlet cavity. The inlet cavity has a configuration and size for sealingly receiving the end of the discharge tube in a friction-fit engagement. A shell surrounds the periphery of the actuator. The shell has an open top providing access to the top surface of the actuator and has a notch adjacent the outlet to permit the discharge of product from the outlet as the actuator is depressed relative to the shell. A plurality of tabs each extends from the actuator to the shell. Each tab is connected to the shell with a frangible web to hold the actuator at an initial, as-molded position relative to the shell. Each frangible web is defined by a reduced cross section thickness of material at an end of the tab. Each tab decreases in width from a greater width dimension at the actuator to a lesser width dimension at the web. Each tab decreases in thickness from a greater thickness dimension at the actuator to a lesser thickness dimension at the web whereby each web can be broken substantially flush with a surface of the shell.

7 Claims, 6 Drawing Sheets

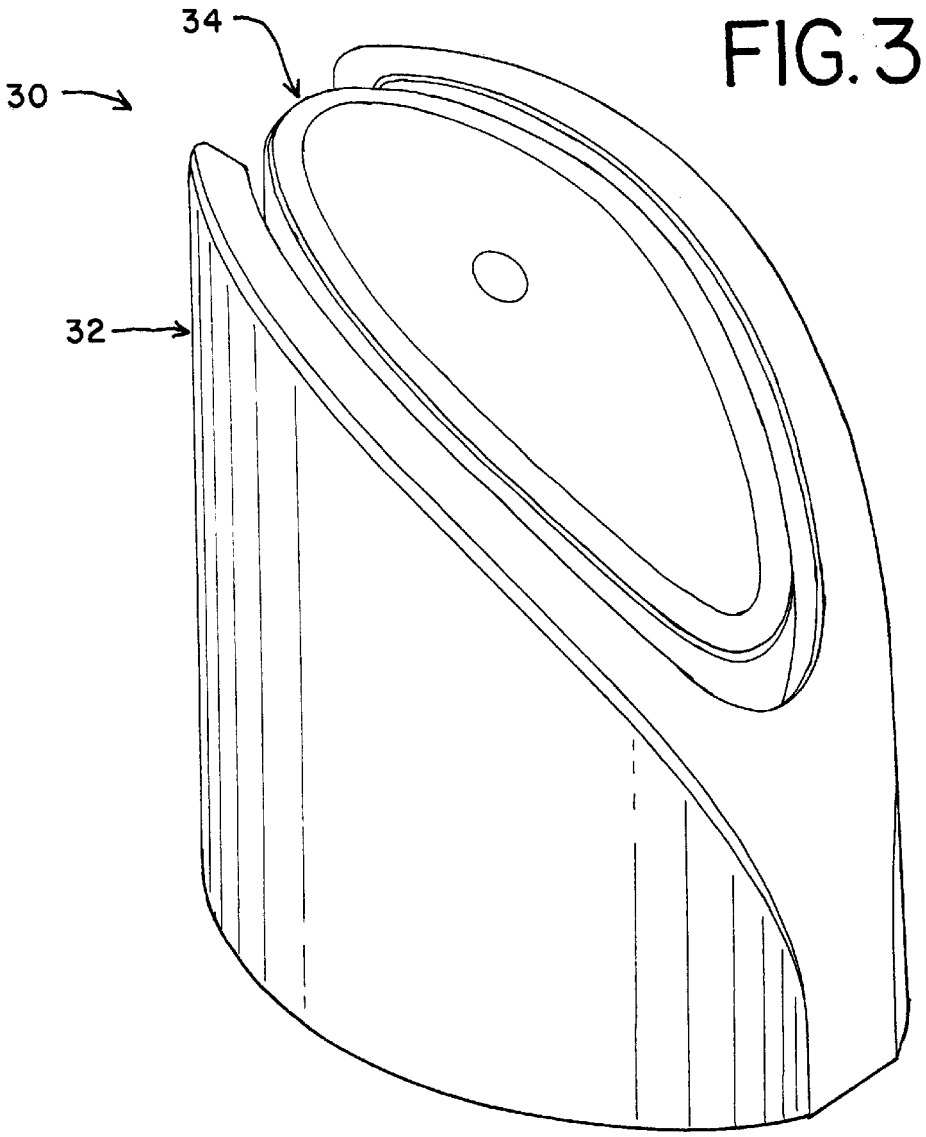
FIG. 3
FIG. 3A
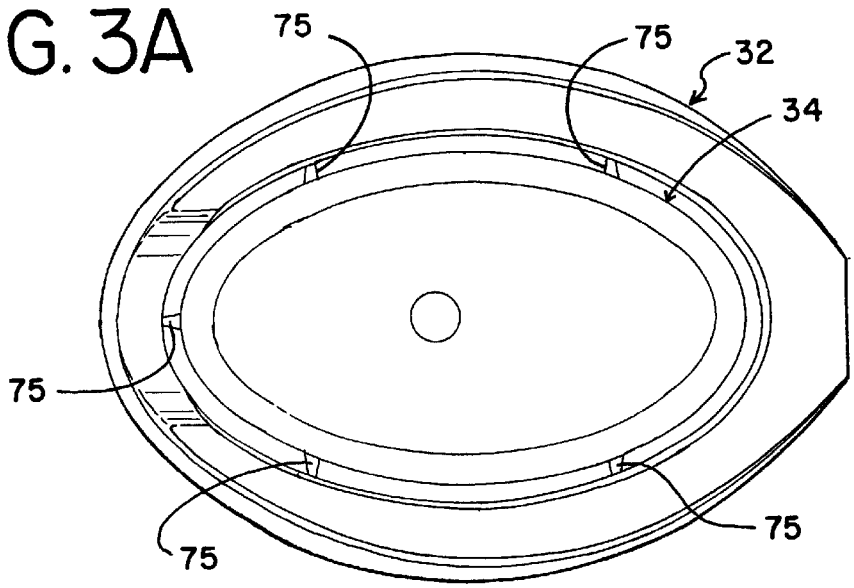

FINGER-ACTUATABLE SPRAY PUMP PACKAGE WITH USER-READY TWO-PIECE SPRAY-THROUGH CAP, PRE-ASSEMBLY CAP, AND METHOD FOR MAKING SAID PACKAGE

TECHNICAL FIELD

The present invention relates to a finger-operable spray pump dispensing package with a user-ready, two-piece, spray-through cap assembly. The invention further relates to a pre-assembly, unitary, overcap structure that includes an actuator and a surrounding shell. The invention also relates to a process for manufacturing and assembling the spray pump package.

BACKGROUND OF THE INVENTION AND TECHNICAL PROBLEMS POSED BY THE PRIOR ART

Finger-operable dispensing pumps are typically adapted to be mounted on hand-held containers. Such containers are commonly used for liquid or paste products, such as household and automotive cleaners, industrial preparations, and personal care products such as hair sprays, deodorants, colognes, and the like. Typically, some pumps operate to produce a fine mist or atomized spray, and other pumps operate to dispense a quantity of product in a liquid or paste form.

Finger-operable pumps conventionally employ a pump chamber in which is disposed a pressurizing piston that can be actuated by pressing down on an external actuator, button, or plunger which is connected to the piston with a hollow discharge tube or stem. The hollow stem establishes communication between the pump chamber and actuator from which the product is discharged. A spring acts against the piston or actuator to return the piston and actuator upwardly to the elevated rest position when the finger pressure is released.

One type of conventional spray pump package includes a container holding the liquid contents, a pump mounted in the container, an actuator or button mounted on the pump, and a shell or overcap mounted on the container or pump around the actuator. The shell or overcap typically provides an aesthetically pleasing peripheral structure surrounding the upper portion of the pump and actuator. The overcap typically has a suitable notch or opening to accommodate discharge of the spray from the actuator when the actuator is depressed to operate the pump.

In order to reduce the cost of manufacture, designs have been proposed in which the actuator and surrounding shell are initially molded together as a unitary structure. The unitary structure is subsequently mounted over the container to be supported by the container or pump housing, and the initial user must break the actuator away from the surrounding shell in order to operate the pump. See, for example, U.S. Pat. No. 4,095,725 and U.S. Pat. No. 3,223,287.

Conventional, molded unitary actuator/overcap systems have some drawbacks and disadvantages. For example, the user must initially break the actuator from the surrounding shell in order to actuate the pump for the first time. The unitary connection or connections between the actuator and the surrounding shell must be readily broken by the user without requiring an unusually high amount of force and/or without requiring that force be directed along a particular line of action that might be awkward for the user.

The manufacture of such a conventional, unitary actuator/overcap must be relatively precisely controlled in order that the frangible connections between the actuator and surrounding shell can be made sufficiently small so that the frangible connections can be broken by application of force which is not too large. If the amount of force required to break the actuator away from the surrounding shell is too large, then a user may find it extremely difficult, or perhaps impossible, to effect breakage and operate the pump. However, if a relatively small force can cause the actuator to be broken away from the surrounding shell, then the actuator may be prematurely broken from the surrounding shell as a result of impacts on the package during manufacturing, shipping, storage, and handling.

It is relatively costly to employ manufacturing techniques for providing a unitary actuator/overcap structure that will permit the actuator to be separated from the overcap when subjected to force which is not too large, but which prevents actuator separation when the force is less than a predetermined lower limit. The manufacturing cost is high, both in the initial cost for the molding equipment as well as in the cost for manufacturing operations, including inspection, testing, etc.

Some pump actuator designs, such as those disclosed in the U.S. Pat. No. 3,367,540, require that the user, during the initial use of the pump, manipulate the package in such a way as to break a frangible connection or connections between the actuator and a peripheral base portion and further manipulate the actuator so as to seat the actuator on the pump discharge tube or stem. The manufacturer must essentially rely on the user to properly manipulate the device with appropriate alignment and with appropriate force application to fully seat the actuator on the pump discharge tube.

In any event, with those designs wherein the user must initially break the actuator from a portion of a unitary molded structure, the user may act somewhat tentatively while initially applying force to the actuator, and the initial operation may not be as smooth or as complete as would be desired. In some cases, the initial actuation may be too slow. A slow actuation speed could result in a slower velocity of the product flow, and that could result in a poor spray.

It would be desirable to provide an improved assembly and manufacturing process for such spray pump packages. It would be advantageous to provide an improved structure which would not require a special hood to cover the top of the actuator to protect the actuator from being prematurely actuated during shipping or storage because the elimination of such a hood would reduce the product cost.

In addition, it would be beneficial if such an improved design could accommodate relatively long actuation strokes (e.g., 7–9 mm) of some pumps.

It would also be beneficial if an improved dispensing package could accommodate incorporation of a more aesthetically pleasing design.

It would also be desirable to provide an improved design of a unitary overcap structure, including an actuator and a surrounding shell, which could be relatively easily molded and that would facilitate economical manufacture, high production quality, and consistent operating parameters unit-to-unit with high reliability.

Such an improved design should also desirably provide a system which can be assembled and installed without expensive, specialized equipment.

Preferably, such an improved system should accommodate designs which will permit assembly by automatic equipment and which will not require the user to effect a final assembly step or otherwise manipulate the system in a way that would be necessary to place the system in condition for normal use.

Such an improved system should desirably accommodate designs which would protect the user's finger from injury or discomfort during actuation of the pump. To this end, such an improved design should minimize, if not eliminate, sharp edges, even after separation of the actuator from the surrounding shell.

It would also be beneficial if such an improved design would operate with little or no scraping of moving parts so as to minimize or eliminate noise, chatter, and wear.

The present invention provides an improved system which can accommodate designs having the above-discussed benefits and features.

SUMMARY OF THE INVENTION

The present invention provides an improved unitary overcap structure that includes an actuator and a surrounding shell for use with a spray pump dispensing package. The design is relatively tolerant of manufacturing variations. The actuator can be connected to the surrounding shell with relatively thick, and easy-to-mold, frangible connections or webs which can be readily broken by machine during the process of assembling the unitary structure over the pump on the container to provide a user-ready, two-piece cap structure. Such frangible connections or webs thus need not be molded with small cross-sectional dimensions that will permit breakage by the normal finger force of a user.

It is advantageous that the present invention permits larger, more robust frangible connections to be employed for connecting the actuator with the surrounding shell. Larger connections more readily accommodate proper and sufficient flow of molten thermoplastic material throughout the mold cavity. Further, the actuator is less likely to be prematurely broken away from the surrounding shell during manufacturing, handling, and shipping to the filler because the more robust frangible webs or connections between the actuator and surrounding shell will be better able to resist external impact loads.

The molded, unitary, overcap structure of the actuator and surrounding shell is easier to mold than a conventional two-piece design and is less costly to manufacture than a two-piece design. The one-piece design of the present invention can be installed on the container and pump at the filler's filling facility more easily than can a conventional two-piece system. The one-piece system can be more easily installed on the pump and container with a single machine wherein the single machine installs the one-piece structure on the container and pump in one operation. Because the present invention employs a molded, one-piece structure, there are no problems in color matching of the actuator and the peripheral shell as can arise with two-piece systems.

The system of the present invention can be operated by the consumer with no risk of injury or discomfort from sharp edges, and the design operates with little or no scraping or noise from the moving parts.

According to one aspect of the present invention, a finger-operable spray pump dispensing package is manufactured and assembled in a ready-to-use condition prior to delivery to a user. The manufacturing and assembly process includes molding a one-piece, unitary overcap structure. The unitary overcap structure includes (1) an actuator defining a discharge passage extending between an outlet and an inlet cavity, (2) a shell surrounding the actuator, and (3) at least one frangible web connecting the shell with the actuator to locate the actuator at an initial, as-molded position relative to the shell.

A liquid product is provided in a container on which is installed a finger-operable pump with an outwardly extending discharge tube biased on the pump from a fully actuated, bottom-of-stroke, lowered position to an unactuated, top-of-stroke, elevated position.

The unitary overcap structure is mounted over the container with the shell engaged with either the container or the pump, or both, to locate the actuator at an initial, elevated position in the shell and to register the actuator inlet cavity with the discharge tube. The actuator may be located at an elevation in which the actuator is either slightly above the end of the discharge tube or is slightly engaged with the end of the discharge tube.

The actuator is then forced away from the initial, elevated position in the shell against the discharge tube to break the frangible web or webs and overcome the bias of the discharge tube and move the discharge tube to the fully actuated, bottom-of-stroke, lowered position. Preferably, the steps of mounting the one-piece overcap structure over the container and forcing the actuator away from the shell to break the frangible web or webs is performed automatically by a single machine. Preferably, such a single machine continues to force the actuator against the discharge tube while the discharge tube is in the fully actuated, bottom-of-stroke, lowered position so as to move the actuator relative to the discharge tube to seat the discharge tube within the inlet cavity of the actuator.

Subsequently, the force on the actuator is terminated so as to permit the discharge tube to be biased to the unactuated, top-of-stroke, elevated position relative to the pump whereby the actuator seated on the discharge tube is recessed within the shell at a final, rest position which is below the as-molded position so that the shell protects the actuator and minimizes the likelihood of the actuator being subjected to external impact sufficient to cause accidental actuation of the pump during shipping or storage.

According to another aspect of the present invention, an improved design is provided for a molded, unitary overcap structure. The structure includes (1) an actuator defining a discharge passage extending between an outlet and an inlet cavity, (2) a shell surrounding the actuator, and (3) at least one frangible web connecting the shell with the actuator to locate the actuator at an initial, as-molded position relative to the shell. In a preferred embodiment, both the actuator and shell include exterior upwardly and rearwardly facing surfaces which are arcuate. In plan view, the shell defines a somewhat elongated (somewhat oval) opening for receiving the actuator. The actuator in plan view has a generally corresponding elongate or oval shape. The periphery of the actuator is connected to the shell in the preferred embodiment with five tabs extending from the actuator to the shell-two on each lateral side and one in the front below the discharge region of the actuator. Each tab is connected to the shell with frangible web.

According to another aspect of the present invention, a molded unitary overcap structure for assembly on a finger-operable spray pump dispensing package is provided so that it can be subsequently modified to a two-piece, ready-to-use condition operatively engaged with the discharge tube of the pump. The actuator has a top surface and a periphery. The actuator defines an outlet, an inlet cavity, and an internal discharge passage extending between the outlet and the inlet cavity. The inlet cavity has a configuration and size for sealingly receiving the end of the discharge tube in a friction-fit engagement. A shell surrounds the periphery of the actuator. The shell has an open top providing access to the top surface of the actuator and has a notch adjacent to the outlet to permit the discharge of product from the outlet as the actuator is depressed relative to the shell. A plurality of tabs each extends from the actuator to the shell. Each tab is connected to the shell with a frangible web to hold the actuator at an initial, as-molded position relative to the shell. Each frangible web is defined by a reduced cross section thickness of material at an end of the tab. Each tab decreases in width from a greater width dimension at the actuator to a lesser width dimension at the web. Each tab decreases in thickness from a greater thickness dimension at the actuator to a lesser thickness dimension at the web whereby each web can be broken substantially flush with a surface of the shell.

According to another aspect of the invention, a manufacturing method or process is provided for making a finger-operable spray-pump dispensing package in a ready-to-use condition prior to delivery to a user. The process includes molding a unitary overcap structure which has (1) an actuator defining a discharge passage extending between an outlet and an inlet cavity, (2) a shell surrounding the actuator, and (3) at least one frangible web connecting the shell with the actuator to locate the actuator at an initial, as-molded position relative to the shell.

A liquid product is provided in a container on which is installed finger-operable pump with an outwardly extending discharge tube biased on the pump from a fully actuated, bottom-of-stroke, lowered position to an unactuated, top-of-stroke, elevated position.

Subsequently, the unitary overcap structure is mounted over the container with the shell engaged with either the container or the pump, or both, so that the actuator is located at an initial, elevated position in the shell and so that the actuator inlet cavity is in registry with the discharge tube.

Subsequently, the actuator is forced away from the initial, elevated position in the shell against the discharge tube to break the frangible web or webs and overcome the bias of the discharge tube and move the discharge tube to the fully actuated, bottom-of-stroke, lowered position. The actuator is continued to be forced against the discharge tube while the discharge tube is in the fully actuated, bottom-of-stroke, lowered position so as to move the actuator relative to the discharge tube to seat the discharge tube within the inlet cavity of the actuator.

Subsequently, the force on the actuator is terminated. This permits the discharge tube to be biased to the unactuated, top-of-stroke, elevated position relative to the pump. The actuator seated on the discharge tube is thus recessed somewhat within the shell at a final, rest position which is below the as-molded position, so that the shell protects the actuator and minimizes the likelihood of the actuator being subjected to external impact sufficient to cause accidental actuation of the pump during shipping or storage.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 3 is a rear, perspective view of the overcap removed from the package shown in FIGS. 1 and 2;

FIG. 3A is a top plan view of the overcap shown in FIG. 3;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the pumps and containers employed with this invention are described in the normal (upright) operating position, and terms such as upper, lower, horizontal, etc., are used with reference to this position. It will be understood, however, that the pumps and components embodying this invention may be manufactured, stored, transported, used, and sold in an orientation other than the position described.

Figures illustrating the pumps and containers show some mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

Figure 1:
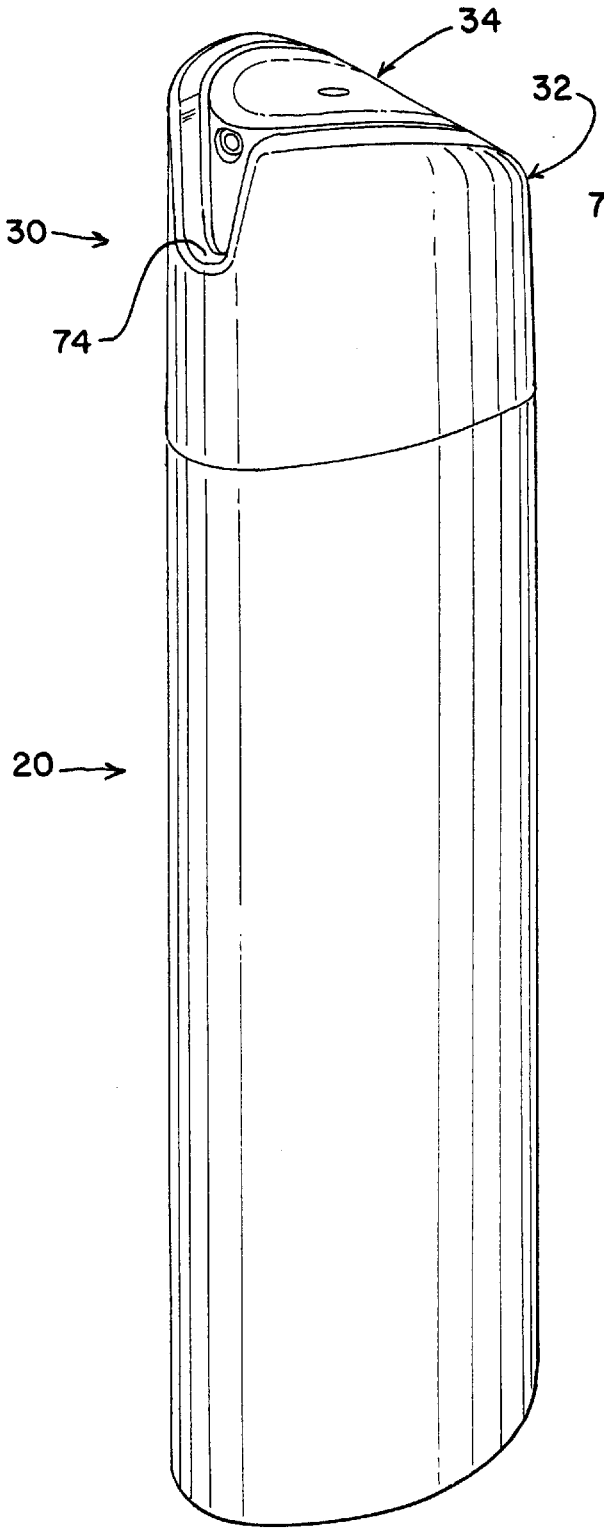
FIG. 1 is a perspective view of a first embodiment of a finger-operable spray pump dispensing package incorporating the present invention, and the package is shown assembled in a ready-to-use condition prior to delivery to a user.
Figure 2:
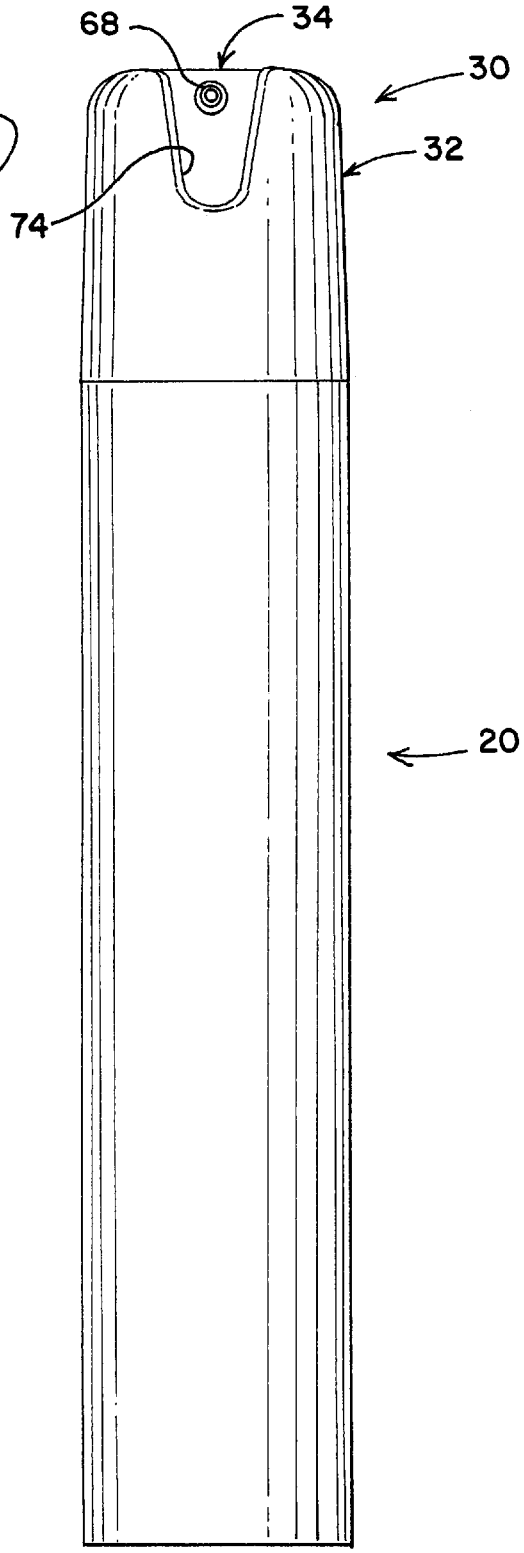
FIG. 2 is a front elevational view of the package shown in FIG. 1.

FIGS. 1 and 2 illustrate a package employing a first embodiment of a unitary overcap structure of the present invention, and the package includes a container 20 and a unitary overcap structure 30. The overcap structure 30 includes a surrounding shell 32 and an inner actuator, button, or plunger 34.

Figure 5:
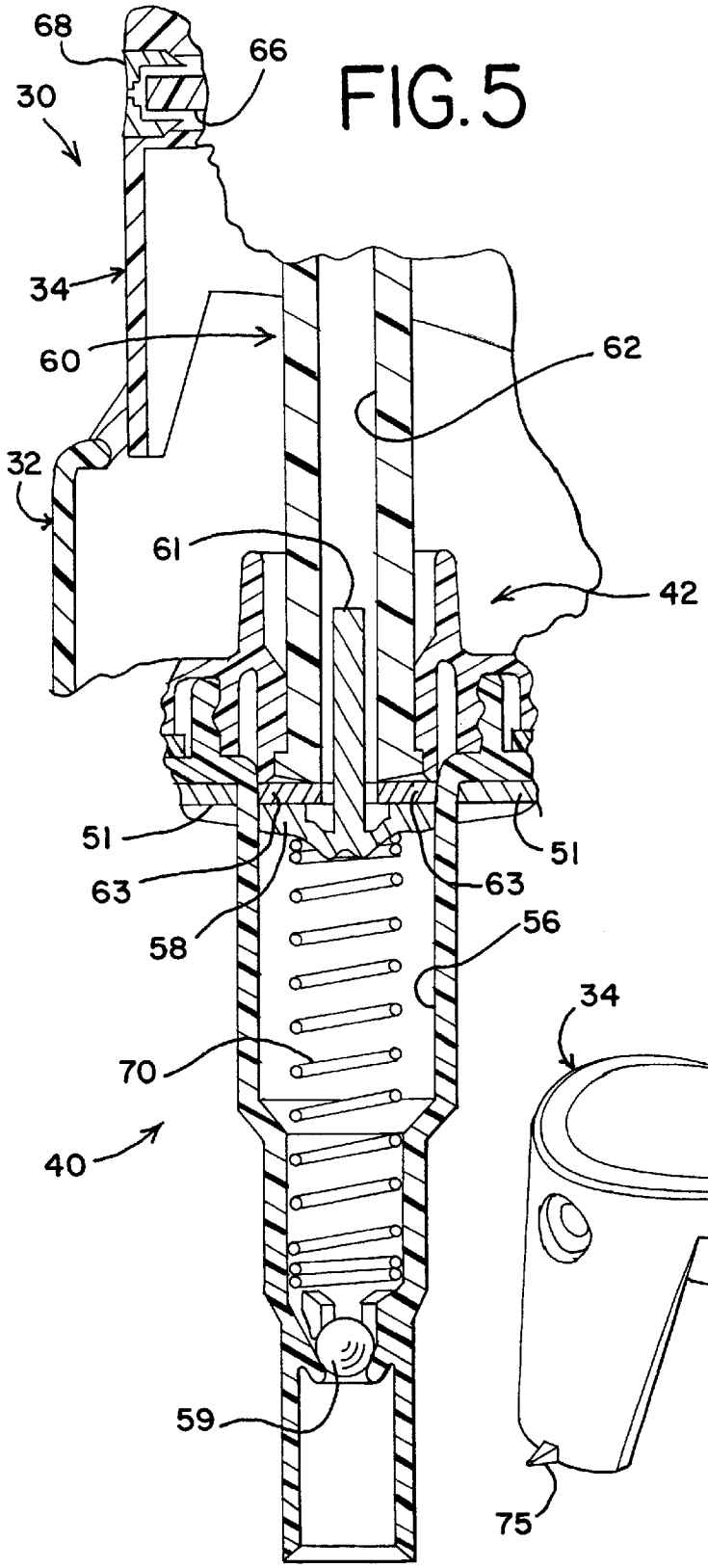
FIG. 5 is a fragmentary, perspective view of the upper portion of the package cut away to show the interior details of the pump and overcap assembly.
Figure 4:
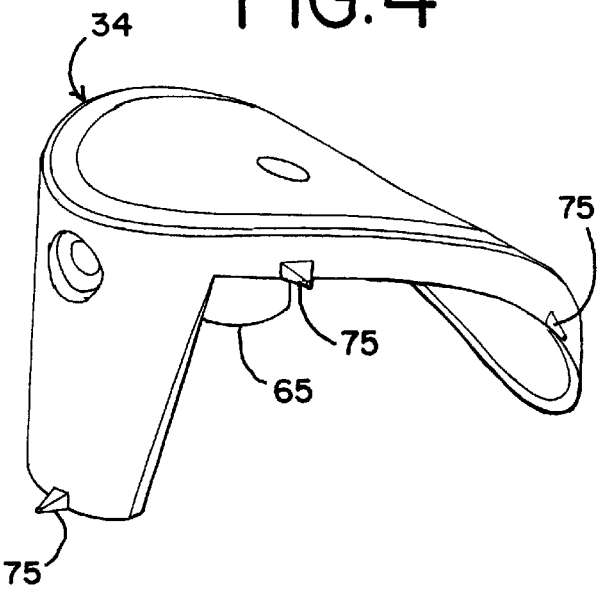
FIG. 4 is a perspective view of the actuator part of the overcap shown in FIG. 3A, and the actuator in FIG. 4 is shown without the surrounding shell of the overcap and prior to installation of the mechanical break-up unit or insert spray nozzle.
Figure 10:
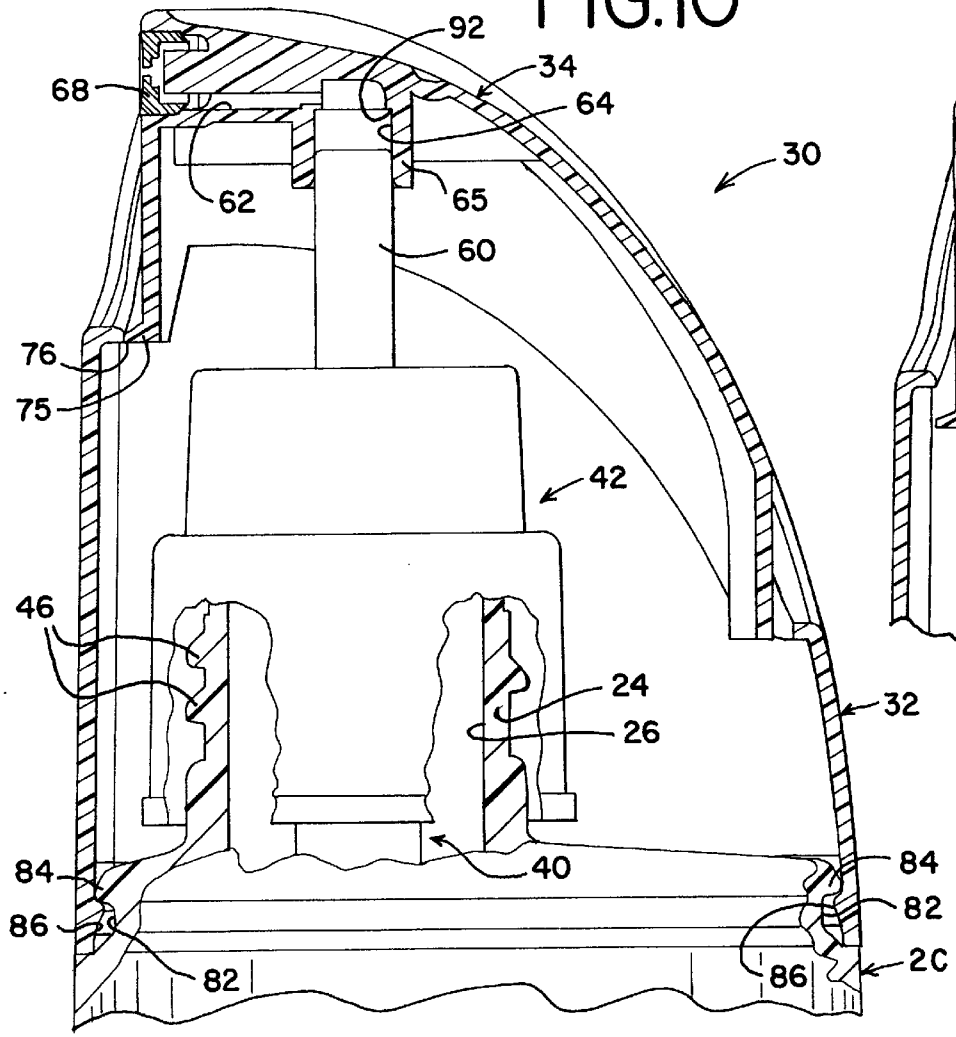
FIG. 10 is an enlarged, fragmentary, cross-sectional view of the unitary overcap structure in the as-molded condition shown mounted over the container with the shell engaged with the container but before the frangible webs between the actuator and surrounding shell have been broken and before the actuator has been fully seated on the pump discharge tube.

FIGS. 5 and 10 illustrate a typical pump 40 that may be employed with the container 20 (FIG. 10) and overcap structure 30. The pump 40 typically has a housing 42 which includes a body and a surrounding closure, cup, cap, or collar with internal threads (not illustrated) for attaching the pump housing 42 to threads 46 (FIG. 10) around the open top of the container 20.

The container 20 is adapted to hold a product (typically a liquid not shown below the pump 40). Typically, the container 20 can be conveniently held in the user's hand.

The container 20 may be made of any suitable material, such as metal, glass, or plastic. A vacuum take-up piston (not illustrated) could be provided in the bottom of the container 20 if desired to assist in the dispensing of a product. The container 20 can have a reduced diameter neck 24 (FIG. 10) defining a mouth or opening 26 into which the pump 40 is inserted. The exterior of the container neck 24 typically defines the threads 46 for engaging the pump collar threads.

A part of the pump 40 extends into the container opening. The bottom end of the pump 40 is attached to a conventional suction tube (not shown), and the upper end of the housing 42 of the pump 40 projects above the container neck 24 (FIG. 10). A conventional sealing gasket 51 (FIG. 5) is typically employed between the pump 40 and container 20. The body of the pump 40 defines an interior chamber 56. A pressurizing piston 58 is disposed in the upper end of the chamber 56, and a non-return check valve ball 59 is disposed in the lower end of the chamber 56. A stem 61 of the pressurizing piston 58 is disposed in a hollow stem or discharge tube 60 which extends out through the top of the pump 40. The hollow stem or tube 60 establishes communication between the pump chamber 56 within the pump 40 and the actuator 34 which is mounted to the upper end of the tube 60. As shown in FIG. 5, a gasket 63 is attached to the upper side of the piston 58.

Figure 7:
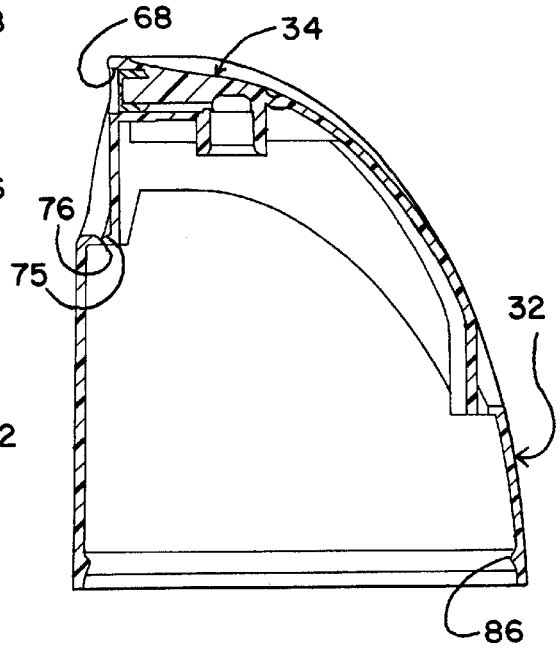
FIG. 7 is a cross-sectional view taken generally along the plane 7—7 in FIG. 6.

The actuator 34 defines a discharge passage 62 (FIG. 9) through which the product from the tube 60 and pump 40 is discharged. The discharge passage 62 extends from a sleeve 65 defining an inlet cavity 64 (FIG. 10) into which the terminal end or distal end of the tube 60 can be press-fit. The discharge passage 62 includes an outlet 66 (FIG. 7) into which can be press-fit a conventional mechanical breakup unit or spray insert nozzle 68 (FIG. 10).

In the lower part of the chamber 56, the interior wall of the pump body defines vertical flow channels (not visible) for accommodating flow up and around the peripheral edge of the piston 58 and gasket 63 when the piston and gasket are moved together by the stem 60 to a lowered position in the chamber 56.

When the actuator 34 is depressed to dispense fluid from the pump 40, the pressurized fluid flows up in the pump chamber body channels (not visible) around the peripheral edge of the piston 58 and gasket 63. The pressurized fluid is forced between the bottom of the gasket 63 and top of the piston 58 into the discharge tube passage 62. The product exits as a fine mist spray from an orifice in the nozzle 68.

A spring 70 acts against the piston 58 inside the pump 40 to bias the piston 58, tube 60, and actuator 34 upwardly to an elevated rest position when finger pressure is released.

After the pump 40 is actuated to dispense a liquid product as an atomized spray (by depressing the actuator 34 to move the tube 60, piston 58, and gasket 63 downwardly), the actuator 34 is released so that the pump components are returned by the spring 70 to the elevated, rest condition (FIG. 5). As the spring 70 moves the pump piston 58 upwardly in the pump chamber 56, the check valve ball 59 opens, and the liquid in the container 20 is drawn up into the pump 40 through the suction tube (not shown). The suction tube typically extends to near the bottom of the container 20. The bottom end of the suction tube is normally submerged in the liquid when the container 20 is in a generally upright orientation as illustrated in FIG. 1.

The pump 40 (including the pump housing 42 and discharge tube 60) and the spray insert nozzle 68 may be of any suitable conventional or special designs. While the present invention may be practiced with pumps of many different designs, one suitable pump is generally disclosed in U. S. Pat. No. 4,986,453, the disclosure of which is hereby incorporated herein by reference thereto. It should be understood, however, that the present invention is suitable for use with a variety of finger-operable pumps.

Figure 11:
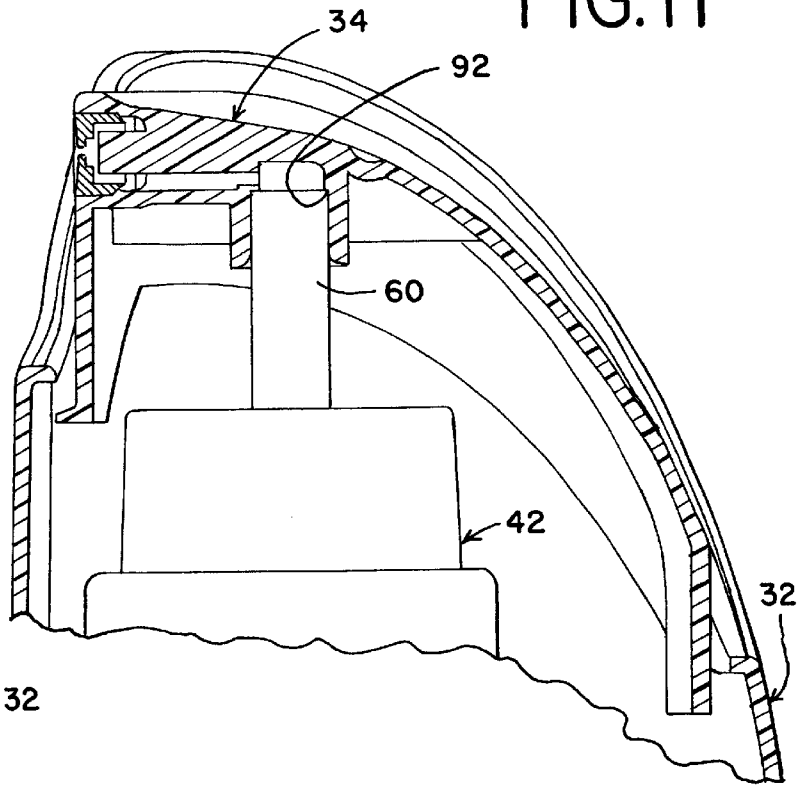
FIG. 11 is a view similar to FIG. 10, but FIG. 11 shows the assembly after the actuator (1) has been initially depressed to break the frangible webs originally connecting the actuator to the surrounding shell and to fully seat the actuator on the upper, distal or terminal end of the pump discharge tube, and (2) has returned (by the biasing force of the pump spring) to an elevated, unactuated, rest position ready for use.

The unitary overcap structure 30 functions to enable a user to operate the pump 40 by pressing down on the actuator 34. The unitary overcap structure also functions to protect the actuator 34 against impact and inadvertent operation, and does not require a hood which must be initially removed in order for the user to operate the pump. The overcap shell 32 surrounds the actuator 34 and extends around the periphery of the actuator. In the ready-to-use condition of the package, as illustrated in FIGS. 1, 2, and 11, the actuator 34 is recessed slightly (e.g., 1 millimeter) below the uppermost surface of the shell 32. This provides a protected region around the sides and top of the actuator 34. The actuator 34 is thus recessed somewhat relative to the top of the shell 32 and the shell minimizes the likelihood of the actuator being subjected to external impact sufficient to cause accidental actuation of the pump during shipping or storage.

Figure 6:
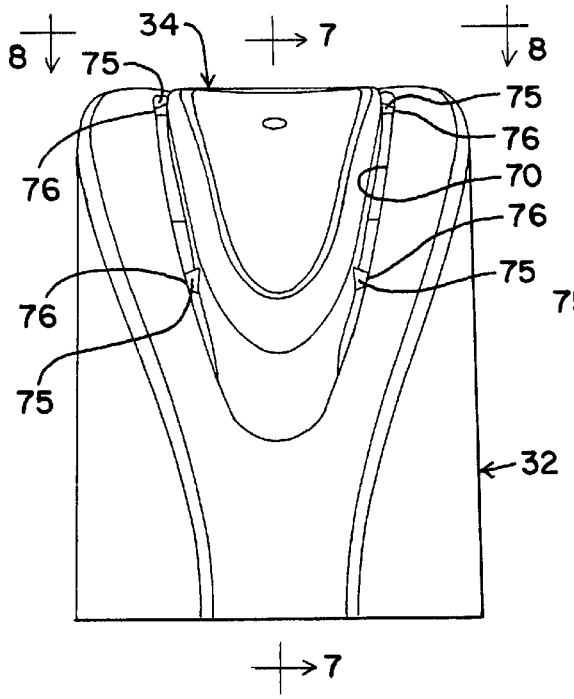
FIG. 6 is a rear view of the unitary overcap structure in the initial, as-molded condition.

The overcap structure 30 is initially molded as a unitary structure as shown in FIGS. 6–10 wherein the actuator 34 is connected to the shell 32. In the first embodiment of the unitary overcap 30 illustrated in detail in FIGS. 6–10, the structure has a generally oval configuration when viewed from the top (as in FIG. 8). As can be seen in FIGS. 6 and 10, the shell 32 includes upwardly and rearwardly facing surfaces which are arcuate and convex when viewed from the exterior.

Figure 9:
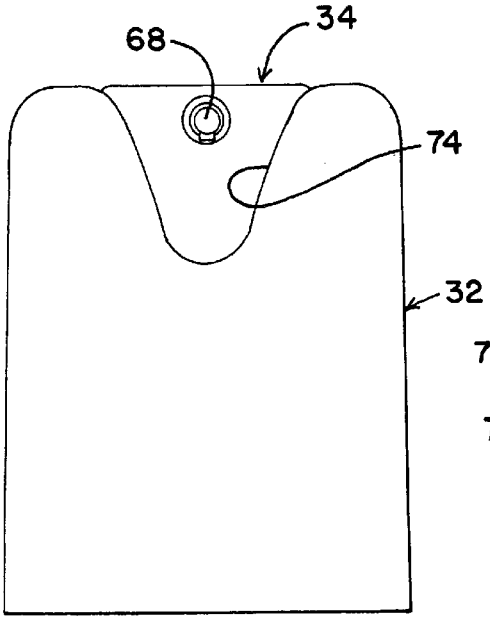
FIG. 9 is a front elevational view taken generally along the plane 9—9 in FIG. 8.
Figure 8:
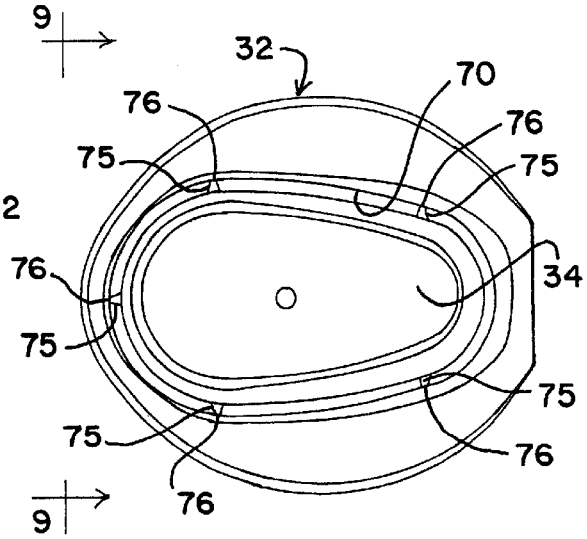
FIG. 8 is a top plan view taken generally along the plane 8—8 in FIG. 6.

The shell 32 defines an elongate or somewhat oval opening 70 when viewed from the top as shown in FIG. 8. The actuator 34 in plan view has a generally corresponding elongate or oval shape. As shown in FIG. 9, the front of the shell 32 includes a concave region or notch 74 to permit discharge of the spray from the nozzle 68 as the nozzle 68 moves downwardly when the actuator 34 is pushed downwardly by the user.

In the as-molded condition (FIGS. 6–10), there is at least one tab 75 extending from the actuator 34 to the shell 32. In the preferred embodiment illustrated in FIG. 8, five tabs 75 extend from the actuator 34 to the shell 32. There are two tabs 75 on each lateral side of the actuator 34 and one tab 75 between the front of the actuator 34 and the shell 32 below the nozzle 68 as can be best seen in FIGS. 3A, 4, 7 and 8.

Each tab 75 is connected to the shell 32 with a frangible web 76. Each frangible web 76 is defined by a reduced cross section thickness of material at the end of the tab 75. Each tab 75 decreases in width from a greater dimension at the actuator 34 to a lesser dimension at the web 76. Each tab 75 decreases in thickness from a greater dimension at the actuator 34 to a lesser dimension at the web 76. Each web 76 can be broken substantially flush with the shell 32.

As illustrated in FIGS. 6–10, the actuator 34 is initially molded as a unitary part of the overcap structure so that the actuator 34 is located at an initial, as-molded position relative to the shell. In the initial, as-molded condition, the top of the actuator 34 is substantially at the top of the shell 32. However, in alternate embodiments, the actuator 34 may be above, or even below, the top of the shell 32. Preferably, however, in order to minimize the likelihood of one or more of the frangible webs 76 being broken during post-molding handling and assembly, the actuator 34 should be surrounded by, and not project too far beyond, the shell 32.

The shell 32 and actuator 34 are initially molded together as a unitary overcap structure from a suitable thermoplastic material such as polypropylene or the like. After the unitary overcap structure is molded, the mechanical breakup unit or nozzle 68 is inserted into the outlet of the actuator 34.

After the overcap unitary structure is molded, it can be delivered to a liquid product manufacturer or filler for applying the overcap to a container and pump package. The filler typically provides a liquid product in a container on which is installed a finger-operable pump having a housing with an outwardly extending discharge tube, such as in the above-described package which includes the container 20 and pump 40. The filler may advantageously employ an automatic assembly machine for installing the unitary overcap structure over the container 20.

As can be seen in FIG. 10, the container 20 may be provided with a conventional receiving groove 82 and bead 84 for receiving a snap-fit bead 86 on the inside bottom edge of the shell 32. The shell 32 is sufficiently resilient to accommodate a temporary, outward deflection as the shell 32 is moved downwardly onto the container so that the shell bead 86 passes over, and then snaps back under, the container bead 84 to provide a snap-fit engagement. In alternate embodiments (not illustrated), the snap-fit bead engagement could be employed between the shell 32 and an appropriate engaging structure on the pump housing 42. In any event, a snap-fit engagement need not be employed. A suitable friction-fit engagement, or other type of engagement, may be employed.

According to the process of the present invention, when the unitary overcap structure 30 is mounted over the container with the shell 32 engaged with either the container 20 or the pump housing 42, or both, the overcap structure is located such that the actuator 34 is at an initial, elevated position in the shell 32 relative to the pump discharge tube 60, and such that the actuator inlet cavity 64 is in registry with the upper end of the discharge tube 60.

When the actuator 34 is at the initial, elevated position over the pump and container, the actuator sleeve 65 (FIG. 10) may be touching, or partially inserted onto, the upper end of the discharge tube 60. Alternatively, the actuator sleeve 65 may be spaced slightly above the distal end of the discharge tube 60. In a preferred embodiment, the inlet cavity 64 in the sleeve 65 is a bore which is slightly tapered so that the bore diameter is largest at the bottom or distal end of the sleeve 65. The diameter of the inlet cavity 64 anywhere along the sleeve 65 upwardly from the distal end is preferably slightly less than the external diameter of the distal end of the discharge tube 60. Preferably, the sleeve 65 is sufficiently deformable or resilient to accommodate the subsequent insertion of the discharge tube 60 so as to provide a snug engagement when the discharge tube 60 is fully seated within the inlet cavity 64 described in more detail hereinafter.

The assembly process is preferably continued by the machine which applies a force to the actuator 34 so as to move the actuator downwardly away from the initial, elevated position in the shell 32 against the discharge tube 60 to break the frangible webs 76 and to overcome the bias of the discharge tube 60 and move the discharge tube 60 to the fully actuated, bottom-of-stroke, lowered position.

The assembly process of the present invention is continued by forcing the actuator 34 away from the initial, elevated position in the shell 32 against the discharge tube 60 while the tube 60 is in the fully actuated, bottom-of-stroke lowered position. This moves the actuator 34 relative to the discharge tube 60 to seat the discharge tube 60 within the inlet cavity 64 of the actuator, as shown in FIG. 11. Preferably, as shown in FIG. 10, the inner portion of the inlet cavity 64 defines a shoulder 92 for terminating the relative movement between the actuator 34 and the discharge tube 60 at a fully seated condition as shown in FIG. 11.

The force on the actuator 34 is terminated, and this permits the discharge tube to be biased by the pump spring 70 (FIG. 5) to the unactuated, top-of-stroke, elevated position relative to the pump (FIG. 11). In this position, the actuator 34 is fully seated on the discharge tube 60, but the actuator 34 is recessed within the overcap shell 32 at a final, rest position which is below the as-molded position (compare the as-molded condition shown in FIG. 10 with the fully assembled condition shown in FIG. 11). The recessed condition of the actuator 34 minimizes the likelihood of the actuator 34 being subjected to external impact sufficient to cause accidental actuation of the pump during shipping or storage.

In the final assembly condition as shown in FIG. 11, the system is ready to be operated by the user. There is no hood that the operator must remove. The operator does not need to break any frangible webs or any other connections in order to operate the pump. Thus, the user may initially concentrate on operating the pump normally the very first time that the pump is actuated by the user. Thus, the user will be able to readily apply a normal operating force at a normal operating stroke rate to produce a proper spray.

Figure 12:
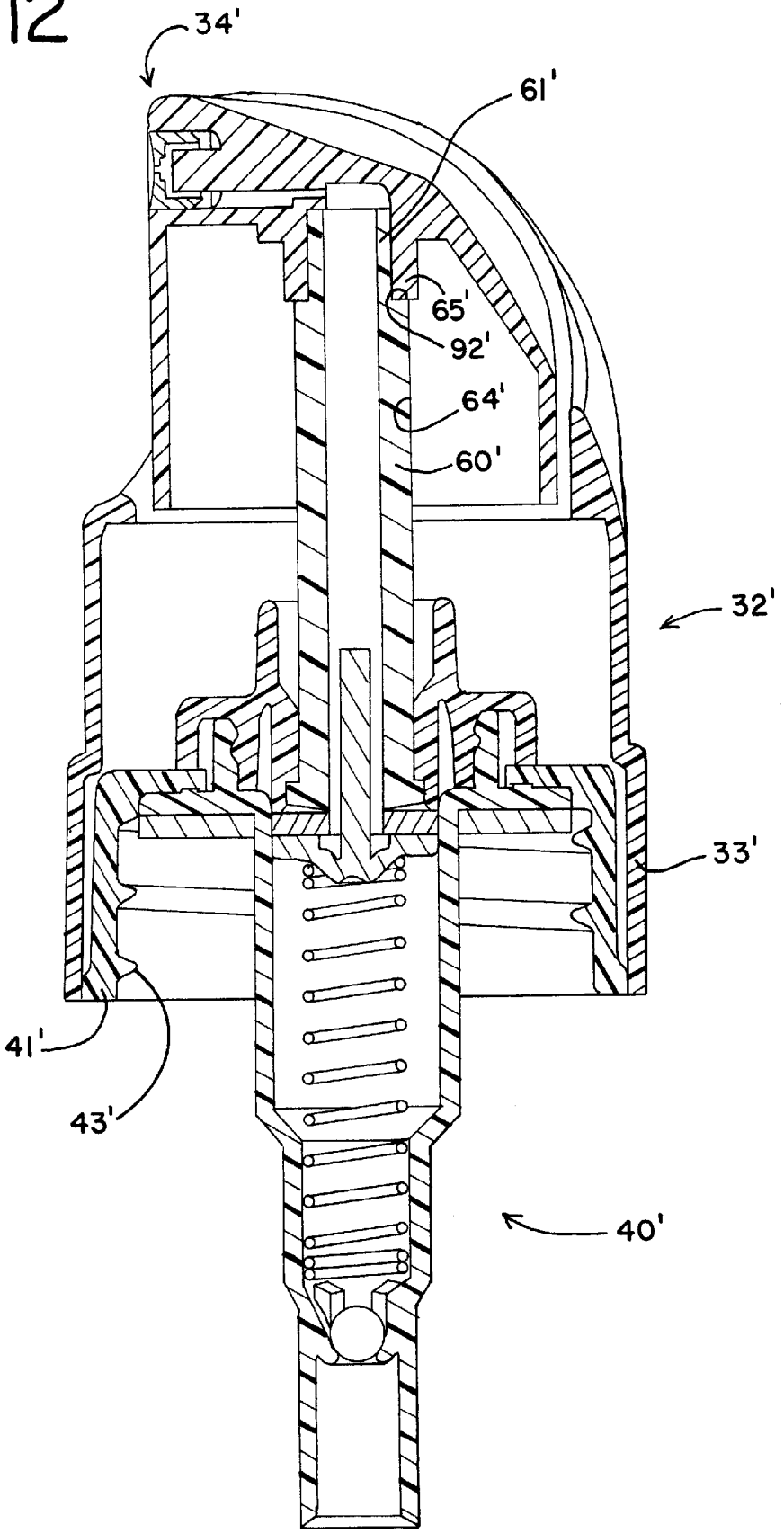
FIG. 12 is a view similar to FIG. 5, but FIG. 12 shows an alternate embodiment of the overcap structure for use with a modified container.

FIG. 12 illustrates an alternate embodiment of an overcap structure of the present invention wherein the overcap structure is adapted for use with a container having a circular, externally threaded neck. A pump, designated generally by reference numeral 40', has substantially the same internal construction as the pump 40 described with reference to the first embodiment illustrated in FIG. 5, but the pump 40' is centered within the overcap structure and within the neck of the container.

The pump includes a housing secured to the container neck (not illustrated) with a closure skirt 41' having internal threads 43'. The skirt 41' may be considered to be part of the housing of the pump 40'.

The overcap structure includes an outer shell 32' and an actuator 34'. The lower portion of the shell 32' has an enlarged diameter skirt 33' which is adapted to frictionally engage the exterior of the pump housing skirt 41.

The actuator 34' includes a sleeve 65' defining an inlet cavity 64' for receiving a reduced diameter distal end portion 61' of the pump discharge tube 60'. The tube 60' includes a shoulder 92' at the end of the sleeve 65' to limit the insertion depth of the dispensing tube 60'.

The actuator 34' is initially molded as a unitary part of the overcap structure along with the shell 32', and the actuator 34' is connected with the shell 32' by means of tabs and frangible webs (not visible) which are substantially identical with the tabs 75 and frangible web 76 described above with reference to the first embodiment illustrated in FIGS. 1–11.

The overcap structure illustrated in FIG. 12 may be installed on a container in substantially the same manner as the first embodiment of the overcap structure 30 described above with reference to FIGS. 1–11 so that the frangible webs are broken and so that the actuator 34' is located somewhat below the top of the shell 32' in a user-ready condition.

With both of the above-described embodiments of the invention, because the actuator is preferably initially broken away from the as-molded condition in the shell by a suitable machine which applies the overcap to the container, the machine can apply a sufficiently large force to readily break the frangible webs. Thus, the frangible webs can each be molded with a relatively large cross section and robust configuration. This will accommodate sufficient flow of thermoplastic material during the molding process so as to adequately and properly fill the mold cavity without problems. Further, relatively large, robust, frangible webs will resist breakage during the release of the unitary overcap structure from the mold, during subsequent processing, during shipping, and during subsequent handling by the filler as the unitary overcap structure is loaded into a suitable machine for installing the unitary overcap over a container on the pump.

Further, owing to the novel arrangement and configuration of the frangible webs, the frangible webs break upon the application of sufficient force in a manner that eliminates extending portions that might result in interference and scraping which could generate noise or inhibit operation, or which could cause discomfort to a user's finger.

The present invention can be employed with pumps having a variety of pump heights and external configurations. The overcap structure of the invention is relatively easy to manufacture with high production quality. A properly designed and assembled system will exhibit consistent operating parameters unit-to-unit with high reliability.

It will be readily apparent from the foregoing detailed description of the invention and from the illustrations thereof that numerous variations and modifications may be effected without departing from the true spirit and scope of the novel concepts or principles of this invention.

What is claimed is:

1. A finger-operable spray pump dispensing package manufactured and assembled in a ready-to-use but impact resistant condition prior to delivery to a user by a process comprising the steps of:

(A) molding a unitary overcap structure including (1) an actuator defining a discharge passage extending between an outlet and an inlet cavity, (2) a shell surrounding said actuator, and (3) at least one frangible web connecting said shell with said actuator to locate said actuator at an initial, as-molded position relative to said shell;

(B) providing a liquid product in a container on which is installed a finger-operable pump having a housing with an outwardly extending discharge tube biased from a fully actuated, bottom-of-stroke, lowered position to an unactuated, top-of-stroke, elevated position;

(C) mounting said unitary overcap structure over said container with said shell engaged with at least one of said container and pump housing to (1) maintain said shell at a fixed location relative to said container with said actuator at said initial, elevated position in said shell, and (2) register said actuator inlet cavity with said discharge tube;

(D) forcing said actuator away from said initial, elevated position in said shell against said discharge tube to break said frangible web and to overcome the bias of said discharge tube and move said discharge tube to said fully actuated, bottom-of-stroke, lowered position;

(E) continuing to force said actuator against said discharge tube while said discharge tube is in said fully actuated, bottom-of-stroke, lowered position to move said actuator relative to said discharge tube to seat said discharge tube within said inlet cavity of said actuator; and (F) terminating the force on said actuator to permit said discharge tube to be biased to the unactuated, top-of-stroke, elevated position relative to said pump whereby said actuator seated on said discharge tube is recessed within said shell at a final, rest position which is below said as-molded position so that said shell minimizes the likelihood of said actuator being subjected to external impact sufficient to cause accidental actuation of said pump during shipping or storage.

2. The package in accordance with claim 1 in which steps (D) and (E) are performed by a machine applying a force continuously to said actuator to effect a continuous movement of said actuator toward said container until said discharge tube is seated within said inlet cavity of said actuator.

3. The package in accordance with claim 1 in which said shell is mounted over said container to effect a snap-fit engagement with one of said container and said pump housing.

4. The package in accordance with claim 1 in which steps (D) and (E) result in said discharge tube being press fit in said inlet cavity.

5. The package in accordance with claim 1 in which said discharge tube has a cylindrical terminal end for being received in said inlet cavity;

said inlet cavity is a bore having an internal diameter less than the external diameter of said discharge tube cylindrical terminal end; and said actuator is deformed around said discharge tube cylindrical terminal end at said inlet cavity during step (E) to accommodate insertion of said discharge tube cylindrical terminal end within said inlet cavity in a snug engagement.

6. The package in accordance with claim 1 in which said inlet cavity includes a depth limiting shoulder engaged with said discharge tube when said actuator is seated on said discharge tube in step (E).

7. A method for manufacturing and assembling a finger-operable spray pump dispensing package in a ready-to-use but impact resistant condition prior to delivery to a user, said method comprising the steps of:

(A) molding a unitary overcap structure including (1) an actuator defining a discharge passage extending between an outlet and an inlet cavity, (2) a shell surrounding said actuator, and (3) at least one frangible web connecting said shell with said actuator to locate said actuator at an initial, as-molded position relative to said shell;

(B) providing a liquid product in a container on which is installed a finger-operable pump having a housing with an outwardly extending discharge tube biased from a fully actuated, bottom-of-stroke, lowered position to an unactuated, top-of-stroke, elevated position;

(C) mounting said unitary overcap structure over said container with said shell engaged with at least one of said container and pump housing to (1) maintain said shell at a fixed location relative to said container with said actuator at said initial, elevated position in said shell, and (2) register said actuator inlet cavity with said discharge tube;

(D) forcing said actuator away from said initial, elevated position in said shell against said discharge tube to break said frangible web and to overcome the bias of said discharge tube and move said discharge tube to said fully actuated, bottom-of-stroke, lowered position;

(E) continuing to force said actuator against said discharge tube while said discharge tube is in said fully actuated, bottom-of-stroke, lowered position to move said actuator relative to said discharge tube to seat said discharge tube within said inlet cavity of said actuator; and (F) terminating the force on said actuator to permit said discharge tube to be biased to the unactuated, top-of-stroke, elevated position relative to said pump whereby said actuator seated on said discharge tube is recessed within said shell at a final, rest position which is below said as-molded position so that said shell minimizes the likelihood of said actuator being subjected to external impact sufficient to cause accidental actuation of said pump during shipping or storage.

* * * * *